US006165414A

United States Patent [19]

Nishikiori et al.

[11] Patent Number: 6,165,414

[45] Date of Patent: Dec. 26, 2000

[54] TITANIUM ALUMINIDE FOR PRECISION CASTING AND METHOD OF CASTING USING TITANIUM ALUMINIDE

[75] Inventors: Sadao Nishikiori, Hoya; Satoshi Takahashi, Yokohama, both of Japan

[73] Assignee: Ishikawajima-Harima Heavy Industries Co., Ltd., Tokyo, Japan

[21] Appl. No.: 09/217,673

[22] Filed: Dec. 21, 1998

[30] Foreign Application Priority Data

Dec. 26, 1997 [JP] Japan ..... 9-366930

[51] Int. Cl.[7] ..... C22C 14/00; C22F 1/18

[52] U.S. Cl. ..... 420/420; 420/418; 148/421; 148/669

[58] Field of Search ..... 148/421, 669; 420/418, 420

[56] References Cited

FOREIGN PATENT DOCUMENTS

| | | | |
|---|---|---|---|
| 620287 | 7/1991 | European Pat. Off. | C22C 14/00 |
| 560070 | 2/1993 | European Pat. Off. | C22C 14/00 |
| 2-274850 | 11/1990 | Japan | C22F 1/18 |
| 6-240428 | 8/1994 | Japan | C33F 1/18 |
| 6-299305 | 10/1994 | Japan | C22F 1/18 |
| 6-299306 | 10/1994 | Japan | C22F 1/18 |
| 7-18392 | 1/1995 | Japan | C22F 1/18 |
| 8-41654 | 2/1996 | Japan | C23C 24/08 |
| 08311585 | 11/1996 | Japan | C22C 14/00 |
| 8-311585 | 11/1996 | Japan | C22C 14/00 |

*Primary Examiner*—Deborah Yee
*Attorney, Agent, or Firm*—McCormick, Paulding & Huber LLP

[57] ABSTRACT

A titanium aluminide having the following chemical composition:

Al: 33.5–34.5 wt %,

Fe: 1.5–2.0 wt %,

V: 1.5–2.0 wt %, and

B: 0.05–0.10 wt %, with the remainder being Ti and inevitable impurities. Greatly decreased is a ratio of $\alpha_2$ phase ($Ti_3Al$) precipitatable in a TiAl matrix. Accordingly, it is possible to deposit a trace amount (2–5%) of thin line-like $\alpha_2$ phase in the TiAl matrix. This titanium aluminide is particularly suitable for precision casting.

15 Claims, 3 Drawing Sheets

TITANIUM ALUMINIDE FOR PRECISION CASTING AND METHOD OF CASTING USING TITANIUM ALUMINIDE

BACKGROUND OF THE INVENTION

1. Field of the Invention

The present invention generally relates to titanium aluminide for precision casting and a method of fabricating a certain product using such titanium aluminide, and more particularly to titanium aluminide containing Fe and V to demonstrate a high creep strength and a precision casting method taking advantage of such titanium aluminide.

2. Description of the Related Art

Titanium aluminide (TiAl alloy) possesses various advantages such as being lightweight, demonstrating satisfactory strength at elevated temperature and having decent rigidity. Therefore, the titanium aluminide is considered as a new favorable material for rotating parts of an aircraft engine and vehicle engine or the like, and there is an increasing tendency to put it to practical use.

Conventionally, Fe, V and B are added to TiAl alloy to fabricate a complicated product by precision casting. By applying an optimum heat treatment, TiAl alloy is also improved in room temperature ductility, workability and fabricability. These techniques and approaches are disclosed in, for example, Japanese Patent Application, Laid-Open Publication No. 8-311585. Another known titanium aluminide for precision casting is disclosed in, for instance, U.S. Pat. No. 5,296,055 issued to Matsuda, entitled "TITANIUM ALUMINIDES AND PRECISION CAST ARTICLES MADE THEREFROM".

However, studies of TiAl alloys are primarily focused on improvements of room temperature ductility so that developed TiAl alloys have relatively low creep strength. Particularly, the creep strength is not very good beyond 700° C.

In order to raise the creep strength of TiAl alloys, there is known a method of adding a third element (Mo, Cr, W, Nb, Ta, etc.) in a TiAl mother alloy. This is called a third element addition method. Another known method is a method of controlling a structure in such a manner that a volumetric ratio of $\gamma$ phase (TiAl) is raised in a TiAl alloy ("structure-controlling method).

However, the third element addition method considerably deteriorates precision castability of TiAl alloy so that a complicated product cannot be moldable. The structure-controlling method causes the room temperature ductility of TiAl alloy to drop below 0.5% so that machinability is greatly degraded.

SUMMARY OF THE INVENTION

One object of the present invention is to provide titanium aluminide for precision casting and method of precision casting which can eliminate the above described problems of the prior art and improve room temperature ductility, workability, fabricability, castability and creep strength.

According to one aspect of the present invention, there is provided titanium aluminide for precision casting, having the following chemical composition:

Al: 33.5 to 34.5 wt %,

Fe: 1.5 to 2.0 wt %,

V: 1.5 to 2.0 wt %, and

B: 0.05 to 0.10 wt %, with the remainder being Ti and inevitable impurities. This chemical composition greatly decreases a ratio of $\alpha_2$ phase ($Ti_3Al$) precipitatable in a TiAl matrix. Accordingly, it is possible to deposit a trace amount (2 to 5%) of thin line-like $\alpha_2$ phase in the TiAl matrix. This titanium aluminide is particularly suited for precision casting. The titanium aluminide demonstrates a fracture period of about 80 to 20,000 hours when a load of about 130 to 270 MPa is applied at 760° C. Therefore, the titanium aluminide of the invention has a remarkable creep strength at an elevated temperature. Consequently, the titanium aluminide can be used for rotating and stationary members of an aircraft engine such as blades, vanes and rear flaps and for a rotating member of an automobile engine such as a turbocharger rotor.

According to another aspect of the present invention, there is provided a method comprising the steps of:

A) preparing a melt of TiAl having the following chemical composition:

Al: 33.5–34.5 wt %,

Fe: 1.5–2.0 wt %,

V: 1.5–2.0 wt %, and

B: 0.05–0.10 wt %, with the remainder being Ti and inevitable impurities;

B) molding a cast utilizing the TiAl melt;

C) applying a heat treatment to the cast at a temperature T given by the following equation for 5 to 20 hours:

$T(°C.)=(1{,}200+25\ (Al(at\ \%)-44))\pm 10$; and

D) cooling the cast at a rate of 100±20 (° C./hr).

This method causes a trace amount of fine line-like $\alpha_2$ phase to precipitate in a TiAl matrix. This method also causes sufficient serration to occur along grain boundaries so that crystal grains engage with-each other in a complicated manner like saw teeth. This significantly increases a total surface area of the grain boundaries and raises a creep strength (particularly, creep strength over 700° C. is enhanced). Therefore, the resulting product is superior in room temperature ductility, processability, fabricability, castability and creep property.

DETAILED DESCRIPTION OF THE INVENTION

Figure 1:
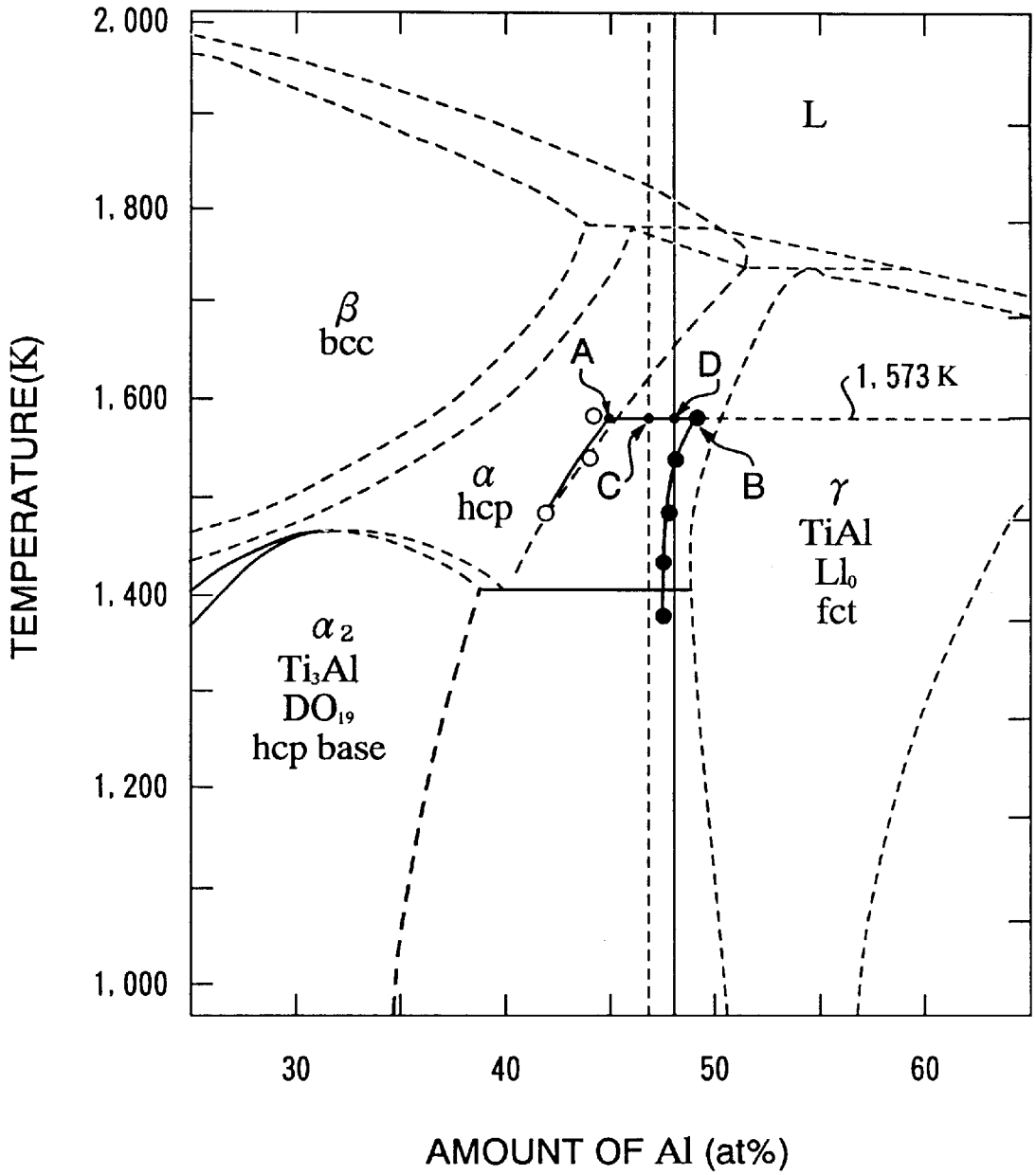
FIG. 1 illustrates a constitutional diagram of binary alloy (titanium aluminide)

Now an embodiment of the present invention will be described in reference to the drawings.

The inventors diligently studied TiAl alloy to improve creep strength without deteriorating room temperature ductility, castability and workability and found the following facts:

1) Fe and V are preferably added to a TiAl mother alloy in substantially the same amount as the conventional material (TiAl alloy disclosed in Japanese Patent Application, Laid-Open Publication No. 8-311585) to maintain appropriate castability, and B is preferably added in a less amount so that a cast has a coarse crystal grain.

2) An amount of Al to be added into the TiAl mother alloy is preferably increased as compared with the conventional TiAl alloy to raise a volumetric ratio of the γ phase and to lower that of the $\alpha_2$ phase ($Ti_3Al$). It should be noted here that mechanical characteristics of the material would be weakened if no $\alpha_2$ phase were precipitated. Thus, the $\alpha_2$ phase is preferably controlled to precipitate 2 to 5%.

3) The mechanical characteristics are generally determined by morphology of the crystal grain boundary. Therefore, a structure is preferably improved by an appropriate heat treatment in such a manner that sufficient serration takes place in the crystal grain boundary of the TiAl alloy.

In consideration of the above 1)–3), the titanium aluminide of the invention has the following chemical composition:

Al: 33.5–34.5 wt %,

Fe: 1.5–2.0 wt %,

V: 1.5–2.0 wt %, and

B: 0.05–0.10 wt %, with the remainder being Ti and inevitable impurities.

Si, which is added to the conventional TiAl mother alloy, is not positively added in the titanium aluminide of the invention since it deteriorates castability.

Next, a method for precision casting according to the invention will be described.

First, a TiAl melt is prepared to have the following chemical composition:

Al: 33.5–34.5 wt %,

Fe: 1.5–2.0 wt %,

V: 1.5–2.0 wt %, and

B: 0.05–0.10 wt %, with the remainder being Ti and inevitable impurities. A basic TiAl material may be purchased and melt. The available material generally does not include the above indicated elements in the above indicated ranges. Thus, insufficient and surplus elements may be added and reduced. Reduction of a particular element may be done by refining. The amounts of elements are monitored during content adjustment such that the melt finally has the weight percent values in the above indicated ranges. Then, this melt of TiAl mother alloy is poured into a die, and cooled. The die may have a complicated shape so that a precision cast results. The melt is generally cooled at a common rate, but may be cooled faster if necessary. This cast is heat treated five to twenty hours at a temperature T defined by the following equation:

$$T(°C.)=(1{,}200+25\ (Al(at\ \%)-44))\pm 10$$

This causes a trace amount of fine line-like $\alpha_2$ phase to precipitate in a TiAl matrix and serration to take place in the crystal grain boundary.

After that, the cast is cooled at a rate of 100±20 (° C./hr).

Since the amounts of elements included in the TiAl mother alloy (melt) are adjusted to have particular values in the predetermined ranges respectively, and appropriate heat treatment and cooling are applied to the cast, the titanium aluminide and the cast obtained from this titanium aluminide have improved room temperature ductility, processability, castability and creep strength.

EXAMPLES

Referring to FIG. 1, illustrated is a constitutional diagram of titanium aluminide. In this diagram, the horizontal axis indicates the amount of Al (at%) and the vertical axis indicates temperature (K). The vertical solid line starting from a point about 48 at % (about 34.2 wt %) on the horizontal axis shows the titanium aluminide for precision casting according to the invention, and the broken line starting from a point about 46.8 at % (about 33.1 wt %) shows the titanium aluminide for precision casting according to the prior art. Unshaded circles indicate contents of Al in the a phase of the conventional titanium aluminide (TiAl alloy disclosed in Japanese Patent Application, Laid-Open Publication No. 8-311585) at different temperatures, and shaded circles indicate contents of Al in the γ phase of the conventional titanium aluminide at different temperatures.

As understood from FIG. 1, the titanium aluminide of the invention includes Al in the TiAl mother alloy in an amount slightly greater than the conventional titanium aluminide. Therefore, the ratio of the $\alpha_2$ phase to the γ phase ($\alpha_2/\gamma$) at about 1,570 K is DB/DA in the invention titanium aluminide as compared with CB/CA in the prior art titanium aluminide as appreciated from a lever relation in the constitutional diagram. This shows that the $\alpha_2$ phase precipitated in the TiAl matrix is significantly reduced.

Figure 2A:
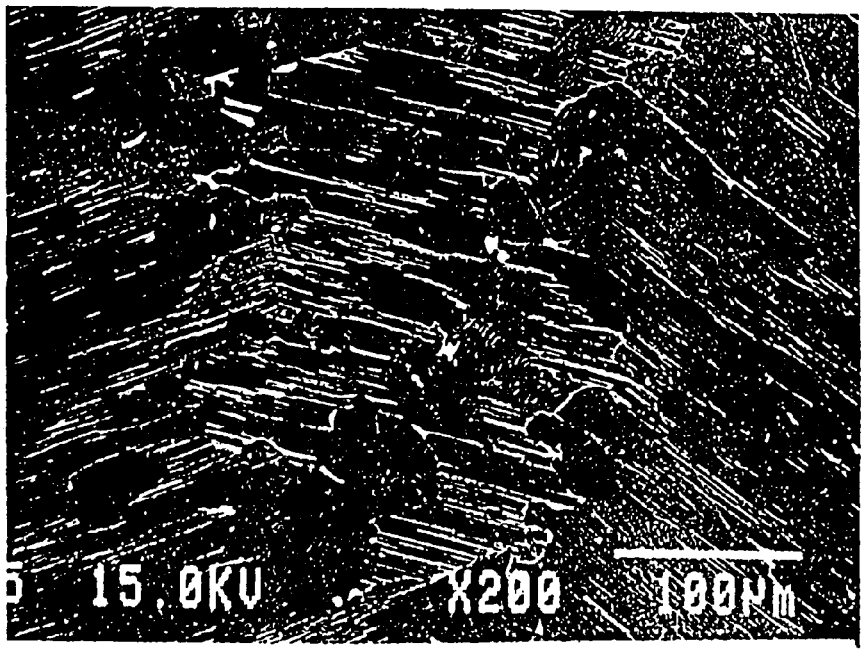
FIG. 2A is a copy of photograph of titanium aluminide structure for precision casting according to the present invention.
Figure 2B:
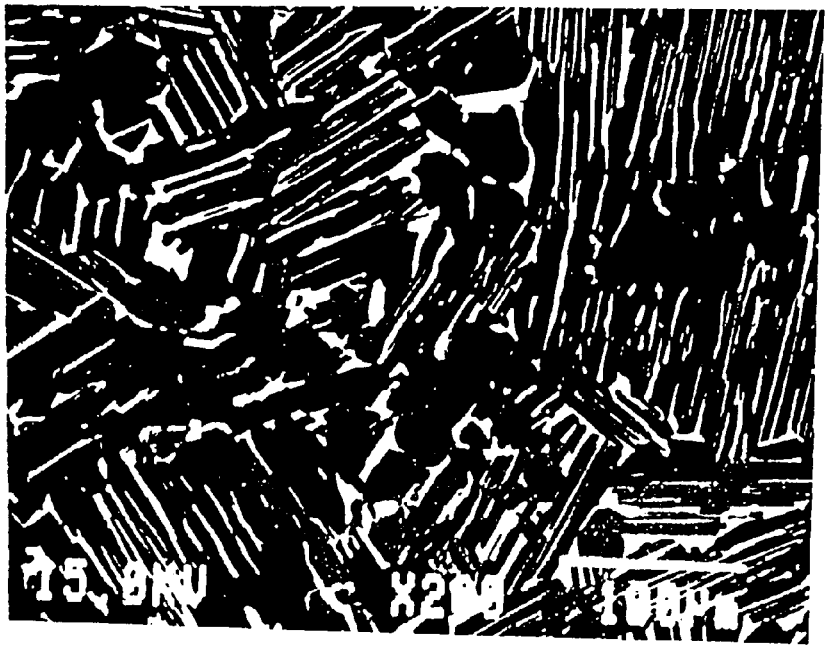
FIG. 2B is a copy of photograph of titanium aluminide structure for precision casting according to prior art.

Referring now to FIGS. 2A and 2B, presented are copies of photograph showing structures of titanium aluminide according to the present invention and the prior art respectively. Specifically, FIG. 2A is an EPMA photograph (×200) of the invention titanium aluminide and FIG. 2B is a similar photograph (×200) of the conventional titanium aluminide.

In FIG. 2B, a large amount of thick line-like $\alpha_2$ phase ($Ti_3Al$) is precipitated in the crystal grain (white thick lines in the drawing). Further, serrations are not seen in the crystal grain boundary very much and equi-axed crystals are present.

In FIG. 2A, on the contrary, thin line-like $\alpha_2$ phase ($Ti_3Al$) is precipitated in the crystal grain boundary (white thin lines in the drawing) and the amount of precipitation is greatly reduced as compared with the conventional material. Further, sufficient serrations are present in the crystal grain boundary so that crystal grains engage with each other in a complicated manner like saw teeth.

Figure 3:
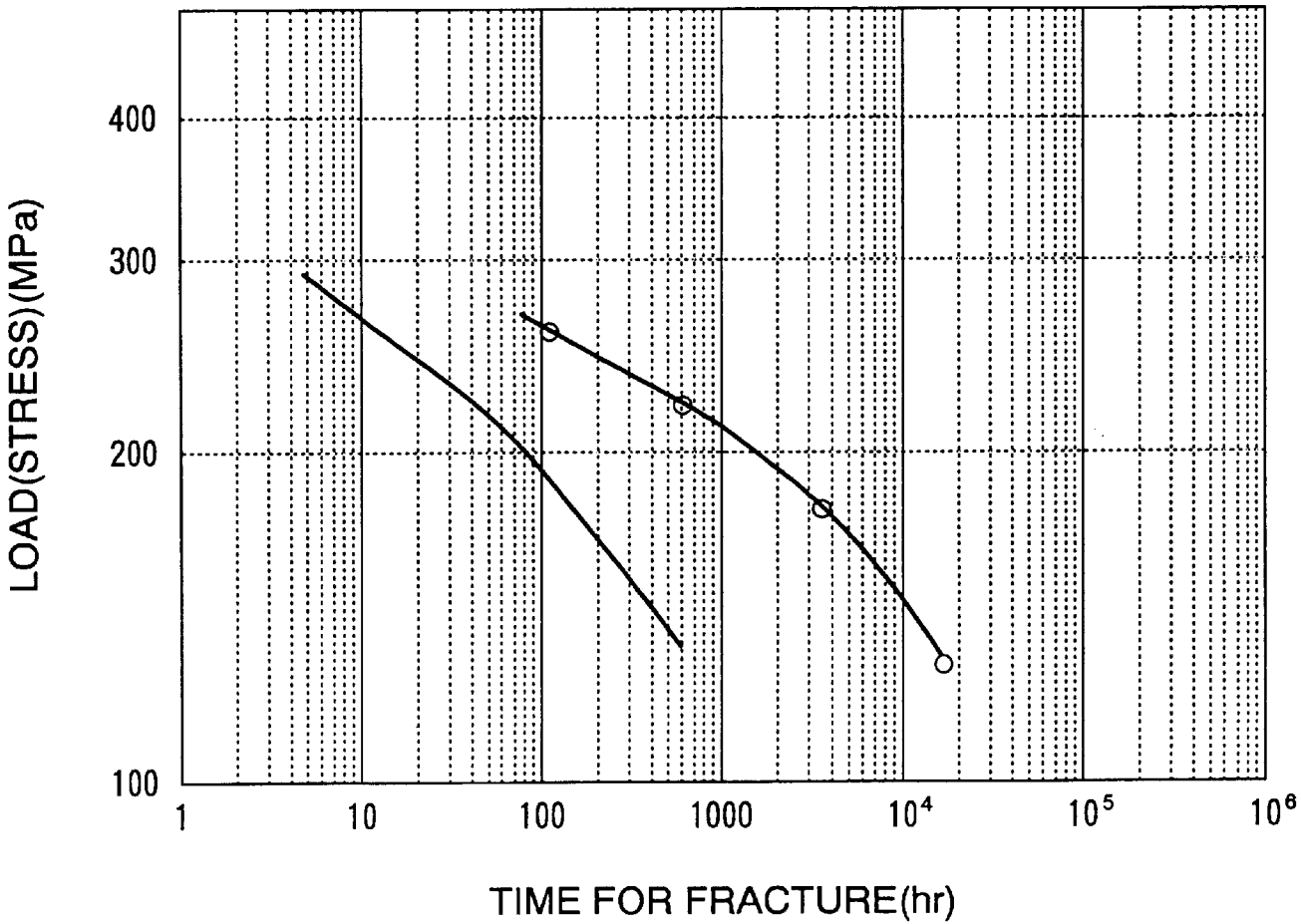
FIG. 3 illustrates creep characteristics of titanium aluminide according to the present invention and prior art.

Referring to FIG. 3, illustrated is a creep strength of the titanium aluminide of the invention and the prior art at a temperature of 760° C. The horizontal axis indicates a time for fracture (hr) and the vertical axis indicates an applied stress (MPa). The line connecting unshaded circles indicates the creep strength curve of the invention titanium aluminide.

As understood from FIG. 3, a time needed until fracture of the invention titanium aluminide is more than ten times as long as the conventional titanium aluminide if the same stress is applied. For example, the fracture time of the invention titanium aluminide is about 80 to 20,000 hours when a stress of about 130 to 270 MPa is exerted. This is an outstanding creep strength at an elevated temperature. FIG. 3 proves that sufficient serrations in the crystal grain boundary and saw-like engagement between crystal grains raise the creep strength.

The titanium aluminide according to the present invention is particularly suited for precision casting. For example, it is used as a material for rotating parts (e.g., blades) and stationary parts (e.g., vanes and rear flaps) of an aircraft engine and for rotating parts of an automobile engine (e.g., turbocharger rotors). The product (cast) obtained from this material has good room temperature ductility, processability and castability and high creep strength. It is of course therefore that the cast product of the invention is also applicable to other parts which require high room temperature ductility, processability, castability and creep strength.

The above described titanium aluminide and casting method are disclosed in Japanese Patent Application No. 9-366930 filed Dec. 26, 1997 with JPO, and the entire disclosure thereof is incorporated herein by reference. The subject application claims priority of this Japanese Patent Application.

What is claimed is:

1. A titanium aluminide for precision casting, having the following chemical composition:

Al: 33.5 to 34.5 wt %,

Fe: 1.5 to 2.0 wt %,

V: 1.5 to 2.0 wt %, and

B: 0.05 to 0.10 wt %, with the remainder being Ti and inevitable impurities, and wherein 2 to 5% by volume of $\alpha_2$ phase included in the TiAl matrix.

2. A titanium aluminide for precision casting, having the following chemical composition:

Al: 33.5 to 34.5 wt %,

Fe: 1.5 to 2.0 wt %,

V: 1.5 to 2.0 wt %, and

B: 0.05 to 0.10 wt %, with the remainder being Ti and inevitable impurities and wherein a time for fracture is about 80 to 20,000 hours when a stress of about 130 to 270 Mpa is applied at 760° C. and 2 to 5% by volume of $\alpha_2$ phase is included in the TiAl matrix.

3. An article of manufacture made from titanium aluminide having the following chemical composition:

Al: 33.5 to 34.5 wt %,

Fe: 1.5 to 2.0 wt %,

V: 1.5 to 2.0 wt %, and

B: 0.05 to 0.10 wt %, with the remainder being Ti and inevitable impurities, and wherein 2 to 5% by volume of $\alpha_2$ phase is included in the TiAl matrix.

4. The article of manufacture according to claim 3, wherein the article of manufacture is a rotating or stationary part of an aircraft engine.

5. The article of manufacture according to claim 3, wherein the article of manufacture is a rotating part of an automobile engine.

6. The article of manufacture according to claim 3, wherein the article of manufacture is made by precision casting.

7. A method comprising the steps of:

A) preparing a melt of TiAl having the following chemical composition:

Al: 33.5 to 34.5 wt %,

Fe: 1.5 to 2.0 wt %,

V: 1.5 to 2.0 wt %, and

B: 0.05 to 0.10 wt %, with the remainder being Ti and inevitable impurities;

B) molding a cast utilizing the TiAl melt;

C) applying a heat treatment to the cast at a temperature T given by the following equation so as to cause 2 to 5% by volume of fine-line-like $\alpha_2$ phase to precipitate in the TiAl matrix:

$T(°C.)=(1,200+25\ (Al(at\ \%))-4)\pm 10$; and

D) cooling the cast.

8. The method of claim 7, wherein the heat treatment of step C is carried out five to twenty hours.

9. The method of claim 7, wherein the cooling of step D is carried out at a rate of 100±20 (° C./hr).

10. The method of claim 8, wherein the cooling of step D is carried out at a rate of 100±20 (° C./hr).

11. The method of claim 7, wherein the step B includes the substep of pouring the melt into a mold of complicated shape.

12. The method of claim 7, wherein the step A includes substeps of acquiring an available material which has a chemical composition as close as possible to a desired chemical composition, and adjusting contents of elements included in the available material such that its chemical composition meets the above indicated criteria.

13. The method of claim 7 further including the step of providing a mold to cast a blade of an aircraft engine before the step B.

14. The method of claim 7 further including the step of providing a mold to cast a rear flap of an aircraft engine before the step B.

15. The method of claim 7 further including the step of providing a mold to cast a turbocharger rotor of an automobile engine before the step B.

* * * * *